US007670476B2

(12) United States Patent
Dierickx et al.

(10) Patent No.: US 7,670,476 B2
(45) **Date of Patent: *Mar. 2, 2010**

(54) PROCESS TO PREPARE A GAS OIL

(75) Inventors: Jan Lodewijk Maria Dierickx, Amsterdam (NL); Arend Hoek, Amsterdam (NL); Lip Piang Kueh, Amsterdam (NL)

(73) Assignee: Shell Oil Company, Houston, TX (US)

( * ) Notice: Subject to any disclaimer, the term of this patent is extended or adjusted under 35 U.S.C. 154(b) by 56 days.

This patent is subject to a terminal disclaimer.

(21) Appl. No.: 11/667,912

(22) PCT Filed: Nov. 18, 2005

(86) PCT No.: PCT/EP2005/056054

§ 371 (c)(1),
(2), (4) Date: Oct. 23, 2007

(87) PCT Pub. No.: WO2006/053894

PCT Pub. Date: May 26, 2006

(65) Prior Publication Data

US 2008/0051477 A1 Feb. 28, 2008

(30) Foreign Application Priority Data

Nov. 18, 2004 (EP) ..... 04105884

(51) Int. Cl.
*C10G 65/16* (2006.01)

(52) U.S. Cl. ..... 208/79; 208/78; 208/134; 208/135; 208/136; 208/137; 208/138; 208/141

(58) Field of Classification Search ..... 208/78–79, 208/134–138, 141, 144; 518/726

See application file for complete search history.

(56) References Cited

U.S. PATENT DOCUMENTS

| | | | | |
|---|---|---|---|---|
| 2,833,698 | A * | 5/1958 | Patton et al. | 208/89 |
| 4,574,043 | A | 3/1986 | Chester et al. | 208/59 |
| 4,859,311 | A | 8/1989 | Miller | 208/89 |
| 4,943,672 | A | 7/1990 | Hamner et al. | 585/737 |
| 5,053,373 | A | 10/1991 | Zones | 502/64 |
| 5,059,299 | A | 10/1991 | Cody et al. | 208/27 |

(Continued)

FOREIGN PATENT DOCUMENTS

| | | |
|---|---|---|
| EP | 587246 | 3/1994 |

(Continued)

OTHER PUBLICATIONS

International Search Report dated Feb. 13, 2006 (PCT/EP2005/056054).

(Continued)

*Primary Examiner*—Robert J Hill, Jr.
*Assistant Examiner*—Brian McCaig

(57) ABSTRACT

Process to optimize the yield of gas oils from a Fischer-Tropsch derived feed by performing the following steps: (a) performing a hydroconversion/hydroisomerisation step on part of the Fischer-Tropsch derived feed; (b) performing a hydroconversion/hydroisomerisation step on another part of the Fischer-Tropsch feed at a conversion greater than the conversion in step (a); and (c) isolating by means of distillation a gas oil fraction from the two reaction products obtained in steps (a) and (b).

17 Claims, 2 Drawing Sheets

U.S. PATENT DOCUMENTS

| | | | | |
|---|---|---|---|---|
| 5,157,191 | A | 10/1992 | Bowes et al. | 585/533 |
| 5,252,527 | A | 10/1993 | Zones | 502/64 |
| 2003/0119924 | A1 * | 6/2003 | Moore et al. | 518/728 |
| 2006/0144755 | A1 * | 7/2006 | Benazzi et al. | 208/108 |

FOREIGN PATENT DOCUMENTS

| | | |
|---|---|---|
| EP | 668342 | 8/1995 |
| EP | 582347 | 9/1996 |
| EP | 776959 | 6/1997 |
| EP | 832171 | 4/1998 |
| WO | WO9201657 | 2/1992 |
| WO | WO9220759 | 11/1992 |
| WO | WO9410264 | 5/1994 |
| WO | WO9718278 | 5/1997 |
| WO | WO9920720 | 4/1999 |
| WO | WO9934917 | 7/1999 |
| WO | WO0029511 | 5/2000 |
| WO | WO0157160 | 8/2001 |
| WO | WO0270628 | 9/2002 |
| WO | WO0270629 | 9/2002 |
| WO | WO2004076598 | 6/2004 |

OTHER PUBLICATIONS

Ryland, Lloyd B., Tamele, M.W., and Wilson, J.N., Cracking Catalysts, Catalysis: vol. VII, Ed. Paul H. Emmett, Reinhold Publishing Corporation, New York, 1960, pp. 5-9.

* cited by examiner

PROCESS TO PREPARE A GAS OIL

PRIORITY CLAIM

The present application claims priority to European Patent Application 04105884.3 filed 18 Nov. 2004.

FIELD OF THE INVENTION

The invention is directed to a process to prepare gas oil from a Fischer-Tropsch derived synthesis product.

BACKGROUND OF THE INVENTION

EP-A-1412459 discloses a process to prepare gas oil having a low cloud point and a cetane number of about 76 as measured according to ASTMD976m.

The present invention discloses a process to optimize the cetane number of a gas oil product from a Fischer-Tropsch derived synthesis product.

SUMMARY OF THE INVENTION

The following process provides a way to optimize the yield of gas oils from a Fischer-Tropsch derived feed by performing the following steps (a) performing a hydroconversion/hydroisomerisation step on part of the Fischer-Tropsch derived feed;

(b) performing a hydroconversion/hydroisomerisation step on another part of the Fischer-Tropsch feed at a conversion greater than the conversion in step (a); and (c) isolating by means of distillation a gas oil fraction from the two reaction products obtained in steps (a) and (b).

Applicants found that by performing steps (a) and (b) in parallel at different conversion levels it is possible to optimize the cetane number of the gas oil as compared to operating a hydroconversion/hydroisomerisation step at an average conversion level.

DETAILED DESCRIPTION OF THE INVENTION

Figure 1:
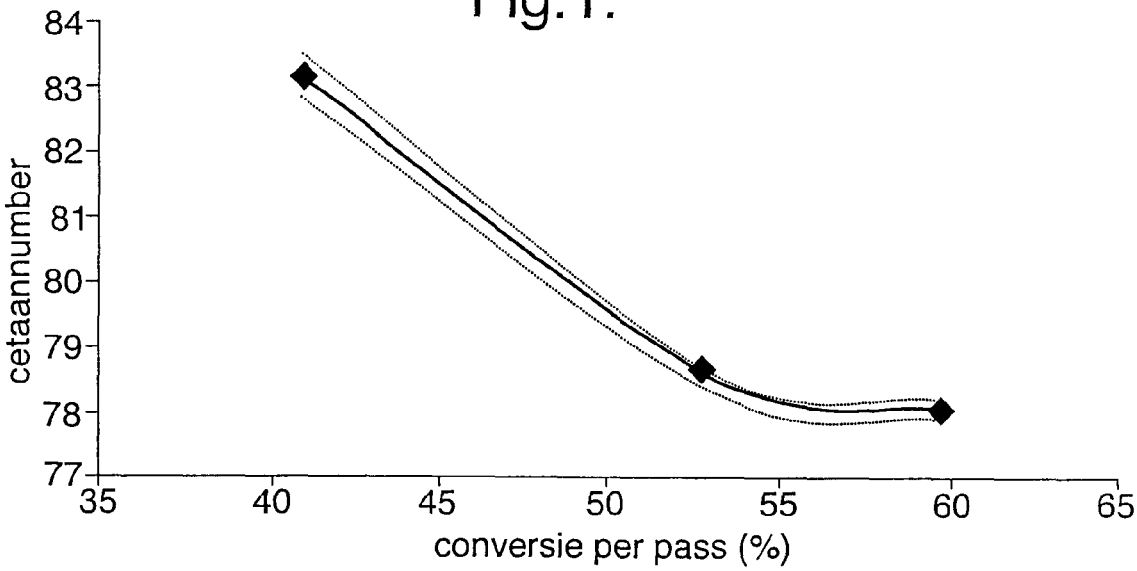
FIG. 1 is a plot of cetane number versus percent conversion.

The Fischer-Tropsch derived feed used in step (a) and/or in step (b) will comprise a Fischer-Tropsch synthesis product. With a Fischer-Tropsch synthesis product is meant the product directly obtained from a Fischer-Tropsch synthesis reaction, which product may optionally have been subjected to a distillation and/or hydrogenation step only. The Fischer-Tropsch synthesis product can be obtained by well-known processes, for example the so-called commercial Slurry Phase Distillate technology of Sasol, the Shell Middle Distillate Synthesis Process or by the non-commercial "AGC-21" Exxon Mobil process. These and other processes are for example described in more detail in EP-A-776959, EP-A-668342, U.S. Pat. Nos. 4,943,672, 5,059,299, WO-A-9934917 and WO-A-9920720. Most of the processes are carried out at a temperature between 200 and 280° C., especially between 210 and 260° C. The catalyst contains often cobalt or iron, preferably cobalt. The pressure is suitably between 10 and 80 bar, especially between 20 and 65 bar. The reactor is usually a fixed bed reactor or a three phase slurry reactor. Typically these Fischer-Tropsch synthesis products will comprise hydrocarbons having 1 to 100 and even more than 100 carbon atoms, e.g. up to 200 carbon atoms or occasionally even more. This hydrocarbon product will comprise normal paraffins, iso-paraffins, oxygenated compounds and unsaturated compounds. Paraffins and unsaturated product, especially olefins, more especially alpha-olefins, are the main constituents of the Fischer-Tropsch derived feed. Depending on the actual reaction conditions, the amount of olefins may vary from 5 to 90 wt % of the total feed stream. The amount of iso-paraffins (and iso-olefins) also depends on the actual reaction conditions. Usually the amount of iso-compounds is up to 25 wt % of the total feed stream, suitably between 1 and 20 wt %, especially between 3 and 15 wt %. The amount of oxygenates is usually up till 10 wt % of the total feed stream, suitably between 0.5 and 6 wt %.

The feed for the process of the invention is suitably the full $C_5$+ fraction of the Fischer-Tropsch process, i.e. no heavy compounds have been removed from the fraction. Other suitable feeds are the full $C_{12}$+ fraction of the Fischer-Tropsch process or the full $C_{18}$+ fraction, i.e. the 200° C. plus fraction or the 310° C. plus fraction of the Fischer-Tropsch process. Optionally also the fraction boiling above 380° C., or even boiling above 750° C., may be used. Preferably the full high boiling fraction are used, i.e. no heavy compounds, e.g. $C_{21}$+ compounds, are removed from the Fischer-Tropsch product. The process of the present invention is preferably carried out with a Fischer-Tropsch feed which is a relatively heavy product. The relatively heavy Fischer-Tropsch product used in step (a) has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}$+ fraction having an ASF-alpha value (Anderson-Schulz-Flory chain growth factor derived from the $C_{20}$ compounds and the $C_{40}$ compounds of the Fischer-Tropsch product stream) of at least 0.925, preferably at least 0.935, more preferably at least 0.945, even more preferably at least 0.955.

Preferably any compounds having 4 or less carbon atoms and any compounds having a boiling point in that range are separated from a Fischer-Tropsch synthesis product before the Fischer-Tropsch synthesis product is used in step (a) or (b).

The Fischer-Tropsch derived feed may be simply split into two equal parts and the two parts are used as feed in steps (a) and (b). For the present invention it is not essential that these two parts are of the same volume. For instance, 25-50 wt % of the total feed may go to step (a) and 50-75 wt % may go to step (b). Furthermore it may be envisaged that the Fischer-Tropsch product from one or more parallel operated Fischer-Tropsch synthesis reactor types, for example slurry bubble or multi-tubular reactor types, are fed to step (a) while one or more other parallel operated Fischer-Tropsch reactors provide the feed for step (b). It may also be envisaged that all the products from all or almost all of the Fischer-Tropsch synthesis reactors are mixed at a so-called common header and that from this combined product the two feeds for step (a) and (b) may be obtained. It is also part of this invention that in addition to step (a) and (b) more parallel operated hydroconversion/hydrocracking reactors are present. It is understood that the Fischer-Tropsch derived feed will then be split over more than two feeds provided that at least two of the reactors operate at a different conversion according to the present invention. The feed streams to step (a) and step (b) may be the same feed streams or different feed streams, but are preferably the same. Preferably each feed stream comprises at least 20 wt % of the feed stream of compounds boiling above 360° C., more preferably at least 40 wt %, even more preferably at least 70 wt %. The feed streams for the steps (a) and (b) may originate from Fischer-Tropsch processes carried out in two different plants, but are preferably from one or more reactors in the same plant. It is observed that the gist of the invention is the optimisation of the yield of gas oils by performing two (or more) hydroconversion/hydrocracking steps. Thus both steps will produce a certain amount of gas oil. It will be clear therefore, that both feed streams at least must contain fractions in the gas oil boiling range. Preferably, the two fractions contain also a fraction boiling above the gas oil boiling range.

The feed for steps (a) and (b) may next to the Fischer-Tropsch derived feed also comprise of mineral crude derived fractions and/or gas field condensates. These additional sulphur containing co-feeds are advantageous when a sulphided catalyst is used in steps (a) and (b). The sulphur in the feed will keep the catalyst in its sulphided form. The sulphur may be removed in a down stream treating unit or, in case the quantities are very low, become part of the product of the present invention.

The hydroconversion/hydroisomerisation reaction of step (a)and (b) is preferably performed in the presence of hydrogen and a catalyst, which catalyst can be chosen from those known to one skilled in the art as being suitable for this reaction of which some will be described in more detail below. The catalyst may in principle be any catalyst known in the art to be suitable for isomerising paraffinic molecules. In general, suitable hydroconversion/hydroisomerisation catalysts are those comprising a hydrogenation component supported on a refractory oxide carrier, such as amorphous silica-alumina (ASA), alumina, fluorided alumina, molecular sieves (zeolites) or mixtures of two or more of these. One type of preferred catalysts to be applied in the hydroconversion/hydroisomerisation step in accordance with the present invention are hydroconversion/hydroisomerisation catalysts comprising platinum and/or palladium as the hydrogenation component. A very much preferred hydroconversion/hydroisomerisation catalyst comprises platinum and palladium supported on an amorphous silica-alumina (ASA) carrier. The platinum and/or palladium is suitably present in an amount of from 0.1 to 5.0% by weight, more suitably from 0.2 to 2.0% by weight, calculated as element and based on total weight of carrier. If both present, the weight ratio of platinum to palladium may vary within wide limits, but suitably is in the range of from 0.05 to 10, more suitably 0.1 to 5. Examples of suitable noble metal on ASA catalysts are, for instance, disclosed in WO-A-9410264 and EP-A-0582347. Other suitable noble metal-based catalysts, such as platinum on a fluorided alumina carrier, are disclosed in e.g. U.S. Pat. No. 5,059,299 and WO-A-9220759.

A second type of suitable hydroconversion/hydroisomerisation catalysts are those comprising at least one Group VIB metal, preferably tungsten and/or molybdenum, and at least one non-noble Group VIII metal, preferably nickel and/or cobalt, as the hydrogenation component. Both metals may be present as oxides, sulphides or a combination thereof. The Group VIB metal is suitably present in an amount of from 1 to 35% by weight, more suitably from 5 to 30% by weight, calculated as element and based on total weight of the carrier. The non-noble Group VIII metal is suitably present in an amount of from 1 to 25 wt %, preferably 2 to 15 wt %, calculated as element and based on total weight of carrier. A hydroconversion catalyst of this type which has been found particularly suitable is a catalyst comprising nickel and tungsten supported on fluorided alumina.

The above non-noble metal-based catalysts are preferably used in their sulphided form. In order to maintain the sulphided form of the catalyst during use some sulphur needs to be present in the feed. Preferably at least 10 ppm and more preferably between 50 and 150 ppm of sulphur is present in the feed.

A preferred catalyst, which can be used in a non-sulphided form, comprises a non-noble Group VIII metal, e.g., iron, nickel, in conjunction with a Group IB metal, e.g., copper, supported on an acidic support. Copper is preferably present to suppress hydrogenolysis of paraffins to methane. The catalyst has a pore volume preferably in the range of 0.35 to 1.10 ml/g as determined by water absorption, a surface area of preferably between 200-500 $m^2/g$ as determined by BET nitrogen adsorption, and a bulk density of between 0.4-1.0 g/ml. The catalyst support is preferably made of an amorphous silica-alumina wherein the alumina may be present within wide range of between 5 and 96 wt %, preferably between 20 and 85 wt %. The silica content as $SiO_2$ is preferably between 15 and 80 wt %. Also, the support may contain small amounts, e.g., 20-30 wt %, of a binder, e.g., alumina, silica, Group IVA metal oxides, and various types of clays, magnesia, etc., preferably alumina or silica.

The preparation of amorphous silica-alumina microspheres has been described in Ryland, Lloyd B., Tamele, M. W., and Wilson, J. N., Cracking Catalysts, Catalysis: volume VII, Ed. Paul H. Emmett, Reinhold Publishing Corporation, New York, 1960, pp. 5-9.

The catalyst is prepared by co-impregnating the metals from solutions onto the support, drying at 100-150° C., and calcining in air at 200-550° C. The Group VIII metal is present in amounts of about 15 wt % or less, preferably 1-12 wt %, while the Group IB metal is usually present in lesser amounts, e.g., 1:2 to about 1:20 weight ratio respecting the Group VIII metal.

A typical catalyst is shown below:

| | |
|---|---|
| Ni, wt % | 2.5-3.5 |
| Cu, wt % | 0.25-0.35 |
| $Al_2O_3$—$SiO_2$ wt % | 65-75 |
| $Al_2O_3$ (binder) wt % | 25-30 |
| Surface Area | 290-325 $m^2/g$ |
| Pore Volume (Hg) | 0.35-0.45 ml/g |
| Bulk Density | 0.58-0.68 g/ml |

Another class of suitable hydroconversion/hydroisomerisation catalysts are those based on zeolitic materials, suitably comprising at least one Group VIII metal component, preferably Pt and/or Pd, as the hydrogenation component. Suitable zeolitic and other aluminosilicate materials, then, include Zeolite beta, Zeolite Y, Ultra Stable Y, ZSM-5, ZSM-12, ZSM-22, ZSM-23, ZSM-48, MCM-68, ZSM-35, SSZ-32, ferrierite, mordenite and silica-aluminophosphates, such as SAPO-11 and SAPO-31. Examples of suitable hydroisomerisation/hydroisomerisation catalysts are, for instance, described in WO-A-9201657 and EP 587246.

The above catalysts are preferably reduced before being used. The metallic catalyst may be obtained as an oxidic or a pre-reduced catalyst. The above catalysts which are used in a sulphided form may be obtained in a oxidic, a pre-sulphided or a presulphurised form. Preferably the start-up procedure of the catalyst manufacturer is followed. Pre-reducing the catalyst for use in a metallic form may also be achieved in situ by reducing the catalyst by contacting with hydrogen. Preferably the contacting is achieved by contacting the catalyst at an elevated temperature with a hydrogen in e.g. nitrogen mixture stream. More preferably the hydrogen content is increased over time and/or the temperature is gradually increased. A skilled person will be able to achieve a successful reduction of the catalyst by applying generally applied skills.

In step (a) and (b) the feed is contacted with hydrogen in the presence of the catalyst at elevated temperature and pressure. The temperatures typically will be in the range of from 175 to 425° C., preferably higher than 250° C. and more preferably from 280 to 400° C. The hydrogen partial pressure will typically be in the range of from 10 to 250 bar and preferably between 20 and 100 bar. The hydrocarbon feed may be provided at a weight hourly space velocity of from 0.1 to 5 kg/l/hr (mass feed/volume catalyst bed/time), preferably higher than 0.5 kg/l/hr and more preferably lower than 2 kg/l/hr. Hydrogen may be supplied at a ratio of hydrogen to hydrocarbon feed from 100 to 5000 Nl/kg and preferably from 250 to 2500 Nl/kg.

Steps (a) and (b) are preferably performed in a reactor provided with beds of the heterogeneous catalyst as described above. Preferably the reactors have the same size. Preferably the reactors have the same type of catalyst.

The conversion in step (a) and (b), which is defined as the weight percentage of the feed boiling above 370° C. which reacts per pass to a fraction boiling below 370° C., is at least 20 wt %, preferably at least 25 wt %, but preferably not more than 90 wt %. The difference in conversion in steps (a) and (b) is preferably more than 5 wt %, more preferably more than 10 wt % and even more preferably more than 15 wt %. The difference will at most be preferably 35 wt %, more preferably at most 30 wt %, still more preferably at most 25 wt %. Preferably the conversion is step (a) is between 30 and 60 wt % and the conversion in step (b) is between 50 and 95 wt %, more preferably between 40 and 80 wt %. The feed as used above in the definition is the total hydrocarbon feed fed to step (a) and (b), thus also any optional recycle of the higher boiling fraction as obtained in the distillation step as described below.

Prior to the hydroconversion/hydroisomerisation step (a) and (b) the feed may optionally be subjected to a mild hydrotreatment step, in order to remove any oxygenates and saturate any olefinic compounds present in the reaction product of the Fischer-Tropsch reaction. Preferably the hydrogenation step reduces the level of oxygenates to below 150 ppm as measured by infrared absorption spectrometry and reduces the level of unsaturated compounds to below the detection limit of the infrared absorption spectrometry. Such a hydrotreatment is for example described in EP-B-668342. The mildness of the hydrotreating step is preferably expressed in that the degree of conversion in this step is less than 20 wt % and more preferably less than 10 wt % even more preferably less than 5 wt %. The conversion is here defined as the weight percentage of the feed boiling above 370° C., which reacts to a fraction boiling below 370° C. After such a mild hydrotreatment lower boiling compounds, having four or less carbon atoms and other compounds boiling in that range, will preferably be removed from the effluent before it is used in step (a). Examples of suitable catalysts are noble metal catalyst as for example platinum based hydrogenation catalysts or non-noble catalysts such as high content nickel catalysts.

In step (c) a gas oil fraction is obtained by separately or combined distilling the effluents of steps (a) and (b). In this distillation step one or more gas oil and lighter fractions and a distillation residue having preferably a T10 wt % boiling point of between 200 and 450° C. is obtained. The separation is preferably performed by means of a distillation at about atmospheric conditions, preferably at a pressure of between 1.2-2 bara, wherein a gas oil product and lower boiling fractions, such as naphtha and kerosine, are separated from the distillation residue. This residue may be recycled to steps (a) and (b).

The naphtha fraction preferably boils for more than 80 wt % between 25 and 200° C., the kerosene fraction preferably boils for more than 80 wt % between 175 and 250° C. and the gas oil fraction preferably boils for more than 80 wt % between 200 and 385° C. Alternatively the kerosene and gas oil fractions are combined. Such a wide boiling gas oil preferably boils for more than 80 wt % between 175 and 385° C.

The gas oil as obtained by the process according to the invention may be blended with one or more of the petroleum crude derived gas oil fraction or gas condensate gas oil fractions. The type and amount of the crude petroleum derived gas oil components will depend on the application and local environmental regulations.

It has been possible to blend the various low sulphur-Fischer-Tropsch and high sulphur-crude petroleum derived gas oil components to fuel compositions having sulphur content of at most 2000 ppmw (parts per million by weight) sulphur, preferably no more than 500 ppmw, most preferably no more than 50 or even 10 ppmw. The density of such a blend is typically less than 0.86 g/cm$^3$ at 15° C., and preferably less than 0.845 g/cm$^3$ at 15° C.

The lower density of such a blend as compared to conventional gas oil blends results from the relatively low density of the Fischer-Tropsch derived gas oils. The above fuel composition is suited as fuel in an indirect injection diesel engine or a direct injection diesel engine, for example of the rotary pump, in-line pump, unit pump, electronic unit injector or common rail type.

The fuel composition itself may be an additised (additive-containing) oil or an unadditised (additive-free) oil. If the fuel oil is an additised oil, it will contain minor amounts of one or more additives, e. g. one or more additives selected from detergent additives, for example those obtained from Infineum (e.g., F7661 and F7685) and Octel (e.g., OMA 4130D); lubricity enhancers, for example EC 832 and PARADYNE 655 (ex Infineum), HITEC E580 (ex Ethyl Corporation), VELTRON 6010 (ex Infineum) (PARADYNE, HITEC and VELTRON are trademarks) and amide-based additives such as those available from the Lubrizol Chemical Company, for instance LZ 539 C; dehazers, e.g., alkoxylated phenol formaldehyde polymers such as those commercially available as NALCO EC5462A (formerly 7D07) (ex Nalco), and TOLAD 2683 (ex Petrolite) (NALCO and TOLAD are trademarks); anti-foaming agents (e.g., the polyether- modified polysiloxanes commercially available as TEGOPREN 5851 and Q 25907 (ex Dow Corning), SAG TP-325 (ex OSi), or RHODORSIL (ex Rhone Poulenc)) (TEGOPREN, SAG and RHODORSIL are trademarks); ignition improvers (cetane improvers) (e.g., 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g., that sold commercially by Rhein Chemie, Mannheim, Germany as "RC 4801", a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g., the pentaerythritol diester of polyisobutylene-substituted succinic acid); corrosion inhibitors; reodorants; anti-wear additives; anti-oxidants (e.g., phenolics such as 2,6-di-tert-butyl-phenol, or phenylenediamines such as N,N'-di-sec-butyl-p-phenylenediamine); and metal deactivators.

The additive concentration of each such additional component in the additivated fuel composition is preferably up to 1% w/w, more preferably in the range from 5 to 1000 ppmw, advantageously from 75 to 300 ppmw, such as from 95 to 150 ppmw.

Figure 2:
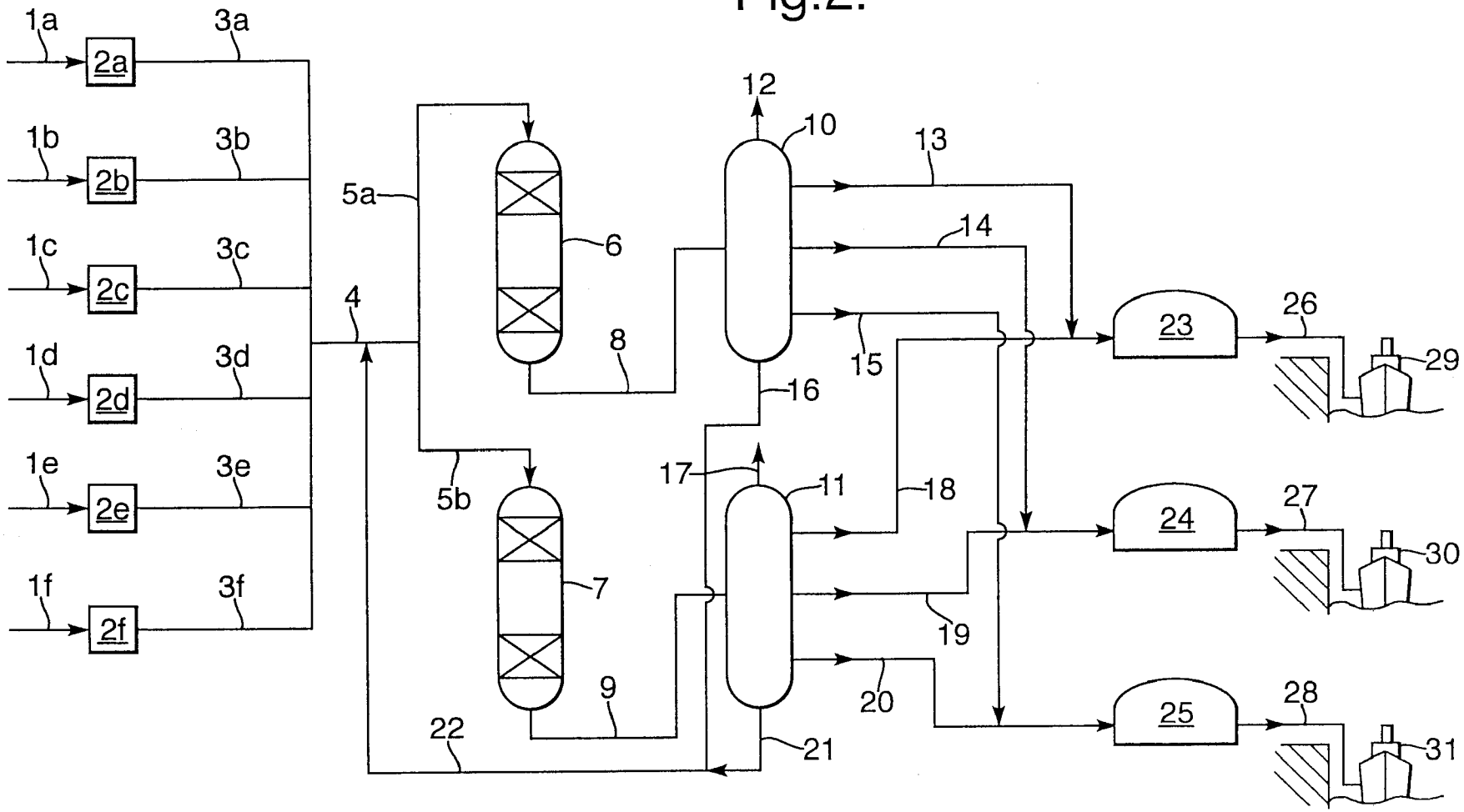
FIG. 2 shows a process scheme in which the process according to the present invention may suitably be carried out.

In FIG. 2 a mixture of carbon monoxide and hydrogen (1*a*-1*f*) is fed to 6 parallel-operated Fischer-Tropsch synthesis reactors (2*a*-2*f*). The Fischer-Tropsch products (3*a*-3*f*) as prepared in said reactors are typically recovered as a liquid product and a gaseous product. The gaseous products are condensed and combined with the liquid products. This is not shown in this FIG. in order to not complicate the FIG. too much. The different products (3*a*-3*f*) are combined to one product stream (4). Stream (4) is mixed with a recycle stream (22) and split into two feeds (5*a*) and (5*b*) which are fed to two parallel-operated hydroconversion/hydroisomerisation reactors (6, 7). These reactors operate at different conditions in order to achieve the different conversion according to the process of the present invention. The reactors (6, 7) are provided with stacked beds of catalyst as schematically drawn. The effluents (8, 9) of the reactors (6, 7) are separately distilled in distillation columns (10,11) operating at atmospheric conditions. In these columns different distillate products are obtained, namely light overhead products (12, 17), a naphtha product (13, 18), a kerosene product (14, 19), a gas oil product (15, 20) and a distillation residue fraction (16, 21), which are combined to stream (22) and recycled mixed with stream (4).

The respective naphtha products (13) and (18) are stored in tank (23). From tank (23) ships (29) can be loaded via transport line (26). The respective kerosene products (14) and (19) are stored in tank (24). From tank (24) ships (30) can be loaded via transport line (27). The respective gas oil products (15) and (20) having the different cetane numbers are stored in tank (25). From tank (25) ships (31) can be loaded via transport line (28).

The invention will be illustrated by the following non-limiting examples.

EXAMPLE 1

Hydrogen and carbon monoxide synthesis gas ($H_2$:CO 2.05 mole/mole.) were converted to heavy paraffins in a tubular Fischer-Tropsch reactor. The catalyst utilized for the Fischer-Tropsch reaction was a titania supported cobalt/manganese catalyst previously described in WO-A-9934917. The pressure was 61 bar, and temperature was adjusted to maintain a Space Time Yield (STY) of 208 kg product per $m^3$ catalyst bed and per hour. The alpha of the Fischer-Tropsch synthesis step was 0.96. The $C_4$ and compounds boiling below said compounds were separated and a substantially $C_5$ plus fraction as further described in Table 1 was obtained in the reactor as a liquid wax and a gaseous fraction, which was subsequently condensed.

TABLE 1

| Fischer-Tropsch synthesis product used as feed was a mixture of the condensed product and the wax as obtained in the F-T reaction | Condensed product | Wax |
|---|---|---|
| Feed space velocity (kg feed/l catalyst bed/h) | .1 | .9 |
| Density (kg/$m^3$) | 754.9 at 15° C. | 749.1 at 150° C., |

TABLE 1-continued

| Fischer-Tropsch synthesis product used as feed was a mixture of the condensed product and the wax as obtained in the F-T reaction | Condensed product | Wax |
|---|---|---|
| | | 733.3 at 175° C. |
| Initial boiling point (° C.) | <5 | 139 |
| T10 wt % boiling point (° C.) | 72 | 403 |
| T30 wt % boiling point (° C.) | 151 | 560 |
| T50 wt % boiling point (° C.) | 209 | 680 |
| T70 wt % boiling point (° C.) | 254 | 741 |
| T90 wt % boiling point (° C.) | 318 | >746 |
| Final boiling point (° C.) | 450 | >746 |
| Oxygenates by IR absorption spectrometry | | |
| Aldehydes + ketones (ppmw O) | 615 | 360 |
| Esters (ppmw O) | 130 | 400 |
| Acids + anhydrides (ppmw O) | <5 | 145 |
| Primary alcohols (ppmw O) | 1135 | 450 |
| Secondary alcohols (ppmw O) | 820 | 375 |

The product of Table 1 was split into two equal fractions having the same properties. Both fractions were subjected to a parallel-operated hydroconversion/hydroisomerisation step wherein the feed was contacted with a 0.8 wt % platinum on amorphous silica-alumina carrier. The conditions in both hydroconversion/hydroisomerisation steps were: a fresh feed Weight Hourly Space Velocity (WHSV) of 1.0 kg/(1.h), and hydrogen gas rate=1000 Nl/kg feed. The total pressure is the first reactor was 31 bar. From the effluent of the hydroisomerisation step a fraction boiling above 540° C. was recycled to said hydroconversion/hydroisomerisation step.

In both reactors the temperature was varied such that in one reactor a conversion per pass of 41 wt % and in the second reactor a conversion per pass of 60 wt % was achieved. From the two hydroisomerisation effluents a gas oil fraction was isolated having the cetane number properties and yields as listed in Table 2.

Comparative A

Example 1 was repeated except that the gas oil was only made in one reactor at a conversion per pass of 53 wt %. From the effluent, a gas oil fraction was isolated having the cetane number properties and yields as listed in Table 2.

TABLE 2

| | Example 1 reactor 1 | Example 1 reactor 2 | Comp. A |
|---|---|---|---|
| Conversion | 41 | 60 | 53 |
| Gas oil yield boiling between 250 and 370° C. (% weight on fresh feed) | 36 | 40 | 39 |
| Cetane number | 83.1 | 78.0 | 78.5 |

Cetane number as measured by IP498/3

The results of Table 2 have been plotted in FIG. 1. In FIG. 1 also the variability of the IP498/3 method is shown as the dotted line, connecting the highest and the lowest reading of 20 repeats. As is shown in this Figure is that the combined cetane number of the reactors 1 and 2 in Example 1 of the gas oil is 1.3 points higher than in Comparative Experiment A. This clearly shows the advantages of operating two hydroconversion/hydroisomerisation reactors in parallel at different conversion levels for obtaining a gas oil product having an improved cetane number.

What is claimed is:

1. A process to optimize the yield of gas oils from a Fischer-Tropsch derived feed by performing the following steps (a) performing a hydroconversion/hydroisomerisation step on part of the Fischer-Tropsch derived feed, the feed comprising at least 20 wt % of the feed stream of compounds boiling above 360° C.;

(b) performing a hydroconversion/hydroisomerisation step on another part of the Fischer-Tropsch feed, the feed comprising at least 20 wt % of the feed stream of compounds boiling above 360° C., at a conversion greater than the conversion in step (a); wherein the composition of the feeds to steps (a) and (b) is the same, and (c) isolating by means of distillation a gas oil fraction from the two reaction products obtained in steps (a) and (b), which is defined as the weight percentage of the feed boiling above 370° C. which reacts per pass to a fraction boiling below 370° C., is at least 20% while the difference in conversion is steps (a) and (b) is more than 5 wt. %.

2. A process according to claim 1, wherein the feed stream to step (a) and to step (b) each comprises at least 40 wt % of the feed stream of compounds boiling above 360° C.

3. A process according to claim 1, wherein the conversion in step (a) is between 40 and 55 wt % and the conversion in step (b) is between 50 and 65 wt %.

4. A process according to claim 1, wherein the difference between the conversion of step (a) and step (b) is between 5 and 35 wt %.

5. A process according to claim 1, wherein the hydroconversion/hydroisomerisation step of step (a) and (b) are performed in two parallel continuously operated reactors each provided with a heterogeneous hydroconversion/hydroisomerisation catalyst.

6. A process according to claim 5, wherein the hydroconversion/hydroisomerization step of step (a) and (b) are performed in two, equally-sized, parallel, continuously-operated reactors each provided with a heterogenous hydroconversion/hydroisomerization catalyst.

7. A process according to claim 1, wherein isolation of the iso-paraffinic products in step (c) is performed in the same distillation step.

8. A process according to claim 1, wherein the feed stream to step (a) and to step (b) each comprises at least 70 wt % of the feed stream of compounds boiling above 360° C.

9. A process according to claim 1, wherein the difference between the conversion of step (a) and step (b) is between 10 and 30 wt %.

10. A process to optimize the yield of gas oils from a Fischer-Tropsch derived feed by performing the following steps (a) performing a hydroconversion/hydroisomerisation step on part of the Fischer-Tropsch derived feed, the feed comprising at least 20 wt % of the feed stream of compounds boiling above 360° C.;

(b) performing a hydroconversion/hydroisomerisation step on another part of the Fischer-Tropsch feed, the feed comprising at least 20 wt % of the feed stream of compounds boiling above 360° C., at a conversion greater than the conversion in step (a); wherein the composition of the feeds to steps (a) and (b) is the same and, and (c) isolating by means of distillation a gas oil fraction from the two reaction products obtained in steps (a) and (b), which is defined as the weight percentage of the feed boiling above 370° C. which reacts per pass to a fraction boiling below 370° C., is at least 20% while the difference in conversion is steps (a) and (b) is between 10 and 30 wt. %.

11. A process according to claim 10, wherein the feed stream to step (a) and to step (b) each comprises at least 40 wt % of the feed stream of compounds boiling above 360° C.

12. A process according to claim 10, wherein isolation of the iso-paraffinic products in step (c) is performed in the same distillation step.

13. A process according to claim 10, wherein the feed stream to step (a) and to step (b) each comprises at least 70 wt % of the feed stream of compounds boiling above 360° C.

14. A process to optimize the yield of gas oils from a Fischer-Tropsch derived feed by performing the following steps (a) performing a hydroconversion/hydroisomerisation step on part of the Fischer-Tropsch derived feed, the feed comprising at least 20 wt % of the feed stream of compounds boiling above 360° C.;

(b) performing a hydroconversion/hydroisomerisation step on another part of the Fischer-Tropsch feed, the feed comprising at least 20 wt % of the feed stream of compounds boiling above 360° C., at a conversion greater than the conversion in step (a); wherein the composition of the feeds to steps (a) and (b) is the same and the hydroconversion/hydroisomerisation step of step (a) and (b) are performed in two parallel continuously operated reactors each provided with a heterogeneous hydroconversion/hydroisomerisation catalyst, and (c) isolating by means of distillation a gas oil fraction from the two reaction products obtained in steps (a) and (b), which is defined as the weight percentage of the feed boiling above 370° C. which reacts per pass to a fraction boiling below 370° C., is at least 20% while the difference in conversion is steps (a) and (b) is more than 5 wt. %.

15. A process according to claim 14, wherein the feed stream to step (a) and to step (b) each comprises at least 40 wt % of the feed stream of compounds boiling above 360° C.

16. A process according to claim 14, wherein isolation of the iso-paraffinic products in step (c) is performed in the same distillation step.

17. A process according to claim 14, wherein the feed stream to step (a) and to step (b) each comprises at least 70 wt % of the feed stream of compounds boiling above 360° C.

* * * * *